US006808153B1

(12) United States Patent
Kelley

(10) Patent No.: US 6,808,153 B1
(45) Date of Patent: Oct. 26, 2004

(54) COLLAPSIBLE MUSIC STAND WITH LIGHT

(76) Inventor: Tracie Anne Kelley, 813 University Ave. SE., Apt. 104, Minneapolis, MN (US) 55414

( * ) Notice: Subject to any disclaimer, the term of this patent is extended or adjusted under 35 U.S.C. 154(b) by 0 days.

(21) Appl. No.: 10/320,174

(22) Filed: Dec. 16, 2002

(51) Int. Cl.[7] ..... A47B 19/00; A47B 23/00; A47B 97/04

(52) U.S. Cl. ..... 248/441.1; 248/125.8; 248/161; 248/188.7

(58) Field of Search ..... 248/125.8, 441.1, 248/443, 161, 188.5, 188.7, 188.6; 362/98

(56) References Cited

U.S. PATENT DOCUMENTS

| | | | | | |
|---|---|---|---|---|---|
| 1,994,225 | A | * | 3/1935 | Lurcott | 248/449 |
| 2,156,489 | A | | 5/1939 | Bonetti | 45/121 |
| 2,474,532 | A | | 6/1949 | Kitchen | 45/121 |
| 2,481,264 | A | | 9/1949 | Tulowiecki | 45/121 |
| 2,732,481 | A | * | 1/1956 | King | 362/98 |
| 4,089,046 | A | * | 5/1978 | Cannon | 362/99 |
| 4,141,273 | A | * | 2/1979 | Austin | 84/484 |
| 4,312,490 | A | * | 1/1982 | Biasini | 248/542 |
| 4,372,518 | A | * | 2/1983 | Biasini | 248/441.1 |
| 4,471,933 | A | | 9/1984 | Nelson | 248/461 |
| 4,744,536 | A | * | 5/1988 | Bancalari | 248/125.8 |
| 5,149,905 | A | * | 9/1992 | Count | 84/744 |
| 5,445,352 | A | * | 8/1995 | Long | 248/354.5 |
| 5,467,958 | A | * | 11/1995 | Selvaggio | 248/449 |
| 5,624,097 | A | * | 4/1997 | Potter | 248/464 |
| 5,692,719 | A | * | 12/1997 | Shepherd | 248/460 |
| 5,713,553 | A | * | 2/1998 | Cooper | 248/461 |
| 5,755,423 | A | | 5/1998 | Michela | 248/459 |
| 5,833,199 | A | * | 11/1998 | Benting et al. | 248/441.1 |
| 5,884,888 | A | * | 3/1999 | Grimes et al. | 248/441.1 |
| 6,017,011 | A | * | 1/2000 | Lee | 248/441.1 |
| 6,079,857 | A | * | 6/2000 | Mendelsohn et al. | 362/427 |
| 6,237,887 | B1 | | 5/2001 | Banner | 248/459 |
| 6,264,161 | B1 | | 7/2001 | Waggoner | 248/460 |

FOREIGN PATENT DOCUMENTS

DE 26 36 231 A1 * 2/1978 ..... F12V/7/00

OTHER PUBLICATIONS

PCT WO 96/19931 (Nilsson) Jul. 4, 1996.*

* cited by examiner

*Primary Examiner*—Ramon O. Ramirez
*Assistant Examiner*—Amy J. Sterling
(74) *Attorney, Agent, or Firm*—Mark A. Litman & Assoc. P.A.

(57) ABSTRACT

A portable music stand comprises a base element that contains therein a telescoping extension and a compressible music rack. The compressible music rack attaches to the extension at a position distal from a bottom of the base, and the extension has a fixing system for supporting the extension at a fixed position relative to the base.

9 Claims, 3 Drawing Sheets

COLLAPSIBLE MUSIC STAND WITH LIGHT

BACKGROUND OF THE INVENTION

1. Field of the Invention

The present invention relates to music stands and particularly to collapsible and portable music stands for sheet music.

2. Background of the Art

The present invention relates to stands of the type typically used to support a musician's sheet music during musical performances and practices, and more particularly to structures of such stands that facilitate disassembly or collapsing for storage and transport of the stands between uses.

Music stands typically include a planar platform or backing, and a shelf or ledge along one edge of the platform and perpendicular to the platform. The platform is supported through a base, and a post or column coupled to the base and platform. The column/platform coupling typically is adjustable to support the platform at an incline from the horizontal, with the shelf extending upwardly and away from the platform in the shelf width direction. Consequently, sheet music lies against the platform with its bottom edge supported by the shelf. While this type of stand most frequently is used by musicians, it also can be used during presentations to support books, sheets of paper and other materials.

One popular music stand features an open-frame construction in which the platform, shelf, column and base are combined in a single, collapsible framework. These stands, while useful in certain circumstances, are light weight and tend to be unstable, particularly when required to support booklets or multiple sheets of music rather than single sheets. Alternatively, the most common music stands of more stable construction are difficult to transport and store.

The prior art includes examples of attempts to impart more stability to more portable music stand designs. For example, U.S. Pat. No. 2,156,489 (Bonetti) shows a music stand with opposite sides that fold into a case when removed from a supporting standard. At the bottom of the standard is a heavy, single-piece base. The base and stand fit into one side of the case.

U.S. Pat. No. 5,713,553 (Cooper) describes a portable stand with a rack formed of opposite side members, each pivotally connected to an upright central spine. The spine is hollow, and includes a closed end and an opposite end with a snap-lock door. Inside the spine is a yoke for mounting the rack pivotally on a telescoping post. At the bottom of the post is a housing that supports three pivoting legs. The post and legs are collapsible to fit within the spine. A somewhat similar design is shown in U.S. Pat. No. 2,481,264 (Tuloweicki). In this design, cover sections on opposite sides of a central plate are hinged to the plate. A compartment behind the plate, or at the bottom of a case formed by the cover sections when closed, stores a telescoping stand and collapsible legs.

U.S. Pat. No. 4,471,933 (Nelson) discloses a music stand with a tray which, together with a support post, fits into a box-like base and cooperates with the base to form an enclosure. U.S. Pat. No. 2,474,532 (Kitchen) shows a combination loose-leaf binder and music stand table.

While having some utility, these satchel or briefcase designs remain relatively large and cumbersome in their storage/transport configurations. They frequently incorporate extra components necessary for storage or closure but having no utility in connection with use in the open configuration as a music stand. In some cases these closure components detract from use, as with rims or flanges along the side edges or upper edges of the music supporting platform, as seen in the Cooper, Tuloweicki and Nelson patents.

Another problem associated with music stands, whether or not portable, is the lack of a capacity to accommodate accessories, e.g. reeds for woodwind instruments, pencils, markers, and valve oil, which the musician may use during a performance or practice. When placed on the shelf supporting sheet music, such accessories tend to interfere with use of the sheet music, and can be knocked off the shelf when a sheet or page is turned. As a result, needed accessories frequently are kept in an instrument case, or on the floor near the music stand, and thus are not as conveniently accessible.

U.S. Pat. No. 6,264,161 describes a music stand comprising:

- a support structure adapted to assume a substantially planar configuration to provide a platform, and further adapted to alternatively assume a closed configuration in which the support structure is turned about at least one longitudinal axis;
- an elongate first wall running lengthwise in the longitudinal direction along one edge of the support structure;
- two substantially longitudinally spaced apart end closure members integral with the first wall, the end closure members having a lateral profile; and
- a mounting structure adapted for a releasable coupling to the support structure when in the planar configuration, to support the platform inclined from the horizontal with said one edge of the support structure forming a lower edge of the platform;
- wherein the mounting structure is collapsible and, when collapsed and disconnected from the support structure, is positionable on the support structure near the first wall, and the support structure when assuming the closed configuration surrounds the end closure members and substantially conforms to the lateral profile and forms a longitudinally extending container adapted to maintain the collapsed mounting structure proximate the first wall.

U.S. Pat. No. 6,237,887 describes a folding stand for use in supporting reading or visual material, said stand having a closed and an operational configuration, said stand comprising:

- a support member, said support member having a surface area bifurcated into a first and a second panel by a first vertical hinge forming a fold line perpendicular to the longest dimension of said support member;
- an elevated shelf connected to said support member by a horizontal hinge running substantially the length of the longest dimension of said support member and said elevated shelf, said elevated shelf bifurcated into a third and a fourth panel by a second vertical hinge forming a fold line contiguous with said fold line of said support member;
- a first and a second foot member, each serving to provide angular support for said support member and said elevated shelf when the stand is in the operational configuration; and
- wherein the stand in the closed configuration comprises a thickness of no more than four panels and a surface area equal to one half of the surface area of the support member's surface area.

U.S. Pat. No. 5,755,423 describes a folding portable support stand suitable for holding a document, copy, sheet music, book, or other article at an elevated angle above a horizontal surface comprising:

(a) a pair of covers, each having a front and back surface, a lower edge and a vertical edge;

(b) a tetrahedral stand assembly having a pair of connectors which are fixedly attached to the back surface of the covers;

(c) a document support means which is hingedly attached to the lower edge of the covers, and wherein the folding portable support stand further comprises:

(d) an open configuration whereby the tetrahedral stand-assembly and covers form an elevated planar surface, and the document supporting means retains the document, copy, sheet music, book, or other article on the covers in the open configuration; and (e) a closed configuration in which the front surfaces of the covers are visible on the outside and whereby the tetrahedral stand assembly, and document supporting means fold flat within the covers and remain assembled ready for use.

Performing musicians require the use of music stands. Those who frequently travel to give performances must have equipment that is easily transportable, compact, and robust. The music stand must also include all elements that will enable the musician to perform without unnecessary hassles caused by inadequate equipment.

SUMMARY OF THE INVENTION

This invention describes a design for a music stand that will eliminate the logistical problems concerning mobility, durability, and a power source for the light. Rather than requiring the use of a clip-on light source with an electrical cord, this music stand will have a built-in, battery-operated light source. The design also allows the music stand to fold up and be condensed into a single protective tube for easy transport. A proposed design is described and discussed.

DETAILED DESCRIPTION OF THE INVENTION

A necessary piece of equipment for traveling musicians is the music stand. However, problems occur involving electrical outlet usage and availability as well as the portability and protection of a light source for the sheet music. Earlier models of the most popular music stands have been made of metal, and provide too many sharp edges. The stands also do not have a built in light source and therefore require a clamped-on lamp. These light sources generally require an electrical outlet for power supply, which causes problems when trying to find enough outlets and extension cords for the number of music stands that may be present in a presentation. Additionally, there tend to be few if any electrical outlets available for outdoor concerts.

The proposed music stand is more compact and preferably has a built-in lamp to eliminate these problems. The design is collapsible, aesthetically-pleasing, and battery-powered. It will also be compact, durable, affordable, and portable.

The design for the music stand has to meet certain criteria. It has to be compact and portable for easy mobility. Because the model is designed primarily for traveling musicians, the design also has to durable to withstand long trips. Furthermore, the costs for production must be reasonable. This will make the product affordable to possible buyers.

Preferably the stand is made from a lightweight planar sheet material, such as a plastics material and it can easily be fabricated from a sheet of plastic making it cost effective to manufacture, and strong, yet light, portable and easily collapsible. Cardboard, ply-wood, wood, metal or compressed board would be suitable alternative materials. According to a preferred embodiment of the invention, an integral handle is incorporated, for example as cooperating holes in the base and one side portion. A clip or tie or strap may be used to hold the portions in their folded state for carrying. A carrying strap could be added.

Figure 1:
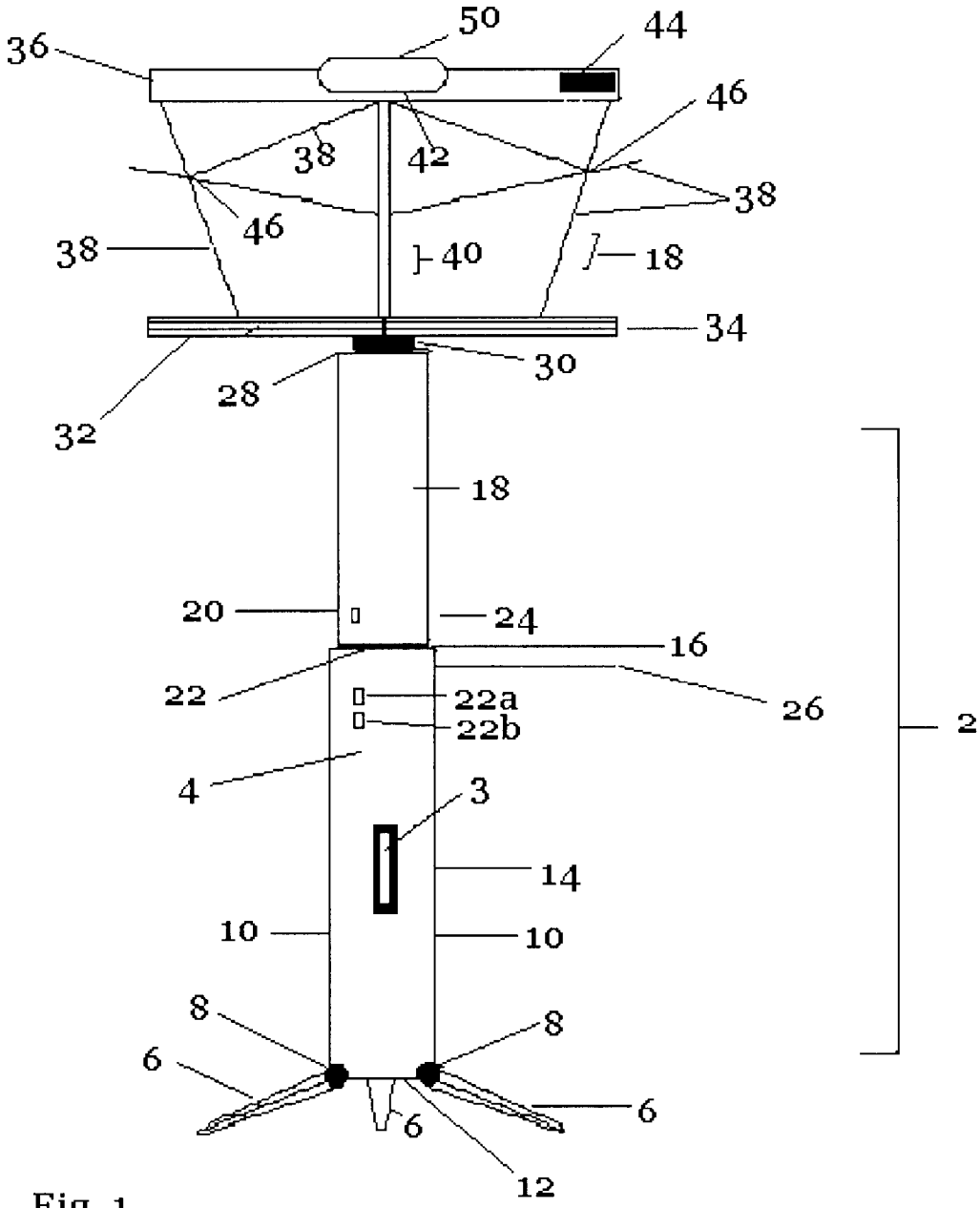
FIG. 1 shows a front view of a music stand according to the invention.

In a carrying mode, the music stand of the invention will appear to be essentially a cylinder of from 10 to 40 centimeters in diameter and from 40 to 150 cm in length. There may be a strap or handle available on the outside of the cylinder to facilitate carrying. Reference to the Figures will facilitate an understanding of the invention. FIG. 1 shows a fully opened stand 2 according to the invention. The stand 2 comprises a base cylinder 4 that also serves as the exterior of the packaged stand, with essentially all other sections of the stand 2 within the base 4. The base 4 is shown with one format of supports, in this FIG. 1, a set of three legs 6. Each leg 6 is provided in this example with a locking hinge 8. The legs 6 may fold upward when unlocked to lie flat against the sides 10 of the base 4, or may retract into a slot or opening (not shown) at the bottom 12 of the base 4. Other formats of legs include legs that snap on and off, one-way flexible legs that can bend to fit into the base 4 and other mechanical constructions. A folding or sliding handle 14 is also shown on the base 4 to enable the user to carry the folded stand 2 when in the base 4 acting as a carrier. The top 16 of the base 4 is an opening that would support a lid (not shown) when all elements of the music stand 2 are within the base 4. Telescoping, sliding or twisting out of the base 4 through the opening 16 is a first extension section 18. The first extension section should have a fixing system to fix the extension 18 into place relative to the base 4. If there are threads 24 on the outside of the extension 18, those threads 24 would mate with interior threads 26 on the interior of the base 4. Any locking mechanism that will allow the extension 18 to be withdrawn from the base 4, yet allow t to remain extended without sliding back into the base 4 because of its own weight or weight supported by the extension is satisfactory. An alternative to the thread system is shown as a protuberance or flange 20 that is shown extending away from the extension 18. The protuberance may be spring loaded to pop out when the protuberance passes beyond the top 16 of the base 4 to extend over the base 4 and support the extension 18. The protuberance 20 would be depressed to slide the extension back into the base 4. An opening 22 may be present on the base to either facilitate movement of the protuberance 20 or to lock the protuberance 20 into a particular position or height. Multiple holes 22*a* 22*b*. etc. may be provided to enable the protuberance 20 to snap into different positions. At the top of the extension 18 is a height adjusting element 30, such as a screw element, accordion element, or telescoping element. The height adjustment element attaches to the base-bar 34 of the music rack 32. The music rack itself 32 comprises the base bar 34, a top bar 36, strengthening cables or wires 38, and a guide bar 40. Any other foldable construction of a music rack 32 that would enable the rack 32 to fold or retract into a size that would fit within the extension 18 would be satisfactory, with the specific format shown in FIG. 1 being preferred. The music rack is shown with a light 42 on the top bar 36. The light may snap onto the top bar 36, may slide along the top bar 36 for position adjustment, may be permanently attached to the top bar 36, replaceably attached to the top bar 36, or the like, but should be battery 44 powered. The battery 44 is shown attached to the top bar 36 but may be located in any convenient location, including as part of the light 42 system. Hinges 48 and 50 are shown on the base bar 34 and the top bar 36, respectively. Slide covers 46 may be placed at the connecting or contacting points of the cables 38 so that they slide more easily against each other.

Figure 2:
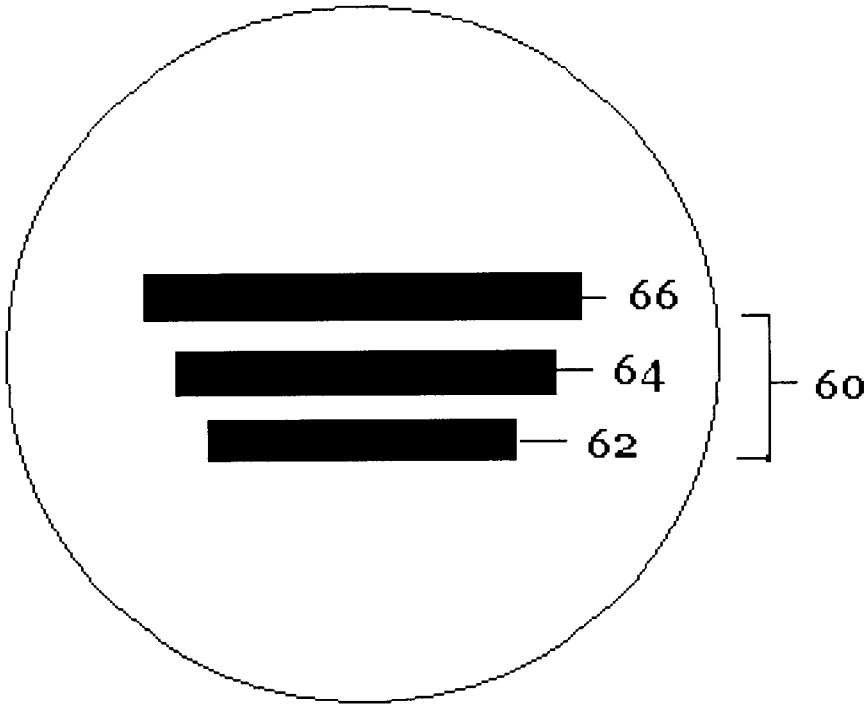
FIG. 2 shows a vertical view of an extension and lid for the music stand.

FIG. 2 shows a top view of the lid 60 of the base 4 (from FIG. 1). The lid 60 may actually extend with the extension from the base 4 in FIG. 1. The three slits 62, 64 and 66 are of different sizes so that a support element on a music rack.(e.g., 32 in FIG. 1) may sit at different height on the lid 60. This will be further understood from a consideration of FIG. 3.

Figure 3:
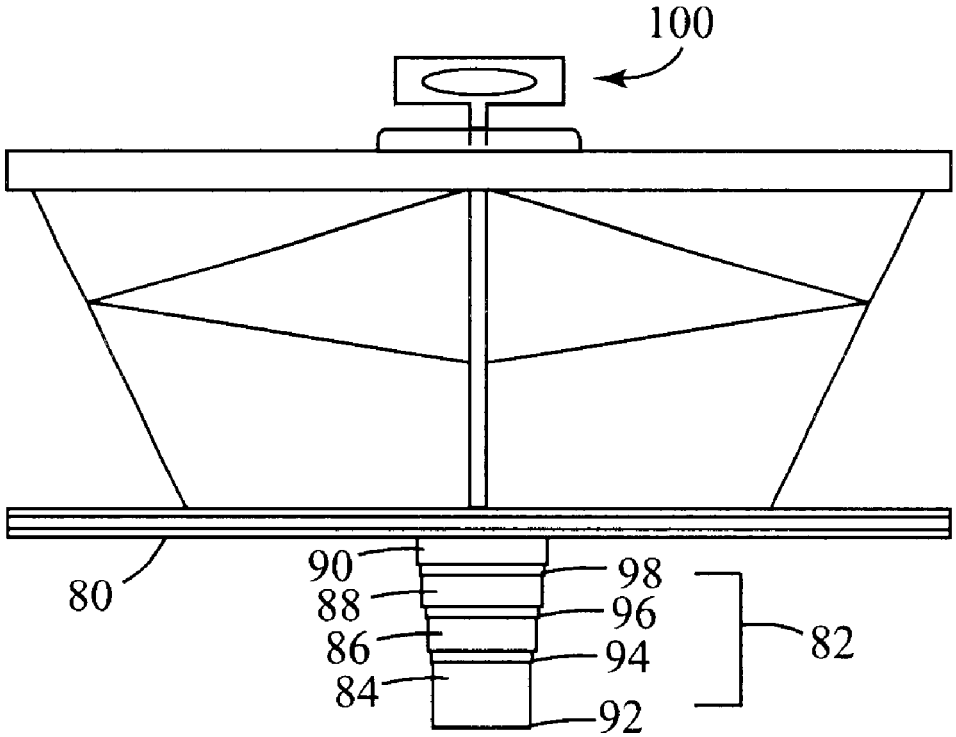
FIG. 3 shows a height adjuster for the music rack.

FIG. 3 shows an extended music rack 80, having a height adjusting base 82 with four segmented diameters 84, 86, 88 and 90. The four segmented diameters form four separate ledges 92, 94 96 and 98 that have differing diameters of lengths and widths. If the height adjusting base 82 is inserted into slot 62 in FIG. 2, the music rack 80 will be supported at a first and highest height. If the height adjusting base 82 is inserted into slot 64 in FIG. 2, the music rack 80 will be supported at a second highest height. If the height adjusting base 82 is inserted into slot 66 in FIG. 2, the music rack 80 will be supported at a last and lowest height.

In FIG. 3, a battery powered light 100 is shown attached to the music rack.

The composition of the music stand may be uniform or vary from piece to piece at the choice of the designer, with the ability to select functioning materials being within the skill of the artisan. For example, the base may be constructed of various combinations of metal, plastic, paper, fiberboard, filled polymer, composite, reinforced polymer and the like. The slide cables of the music rack are preferably metal, but strong synthetic polymers string or cable may be used. The bars of the music rack must likewise be strong, and can be selected from a variety of structural materials, with metal, polymer and reinforced polymer being preferred. The handle may be rigid or flexible, plastic, fabric or the like.

These and other variations within the scope of the invention are intended to be covered the disclosure and the following claims.

What is claimed:

1. An unassembled portable music stand comprising a hollow base having therein a) an extendible element that can be locked into an extended position with respect to the base, b) a compressed music rack that can be expanded to support sheet music, and c) a connecting system to connect the music rack onto the extension wherein a battery powered light attachable to the music rack is also within the hollow base.

2. An unassembled portable music stand comprising a hollow base having therein a) an extendible element that can be locked into an extended position with respect to the base, b) a compressed music rack that can be expanded to support sheet music, and c) a connecting system to connect the music rack onto the extension wherein a battery powered light attached to the music rack is also within the hollow base.

3. The unassembled music stand of claim 1 wherein a handle is present on an outside surface of the base.

4. The unassembled music stand of claim 3 wherein positionable legs are present on the hollow base.

5. The unassembled music stand of claim 4 wherein an end of the extendible element that is farthest from the base when the extendible element is extended has at least two holes of differing sizes thereon.

6. The unassembled music stand of claim 5 wherein a support element on the music rack has at least two segmented cross-sections that can be supported in the at least two holes to position the music rack at different elevations from the extension.

7. The portable music stand of claim 1 having at least three legs that can support the bottom of the base.

8. The portable music stand of claim 7 wherein the at least three legs have swivel attachment to the base and can lock for stability.

9. The portable music stand of claim 1 wherein the hollow base and has a permanent handle to enable the base to be carried by hand.

* * * * *